US006911303B2

(12) United States Patent
Sato et al.

(10) Patent No.: US 6,911,303 B2
(45) Date of Patent: Jun. 28, 2005

(54) LIGHT-SENSITIVE SILVER HALIDE GRAIN

(75) Inventors: Tadanobu Sato, Kanagawa (JP); Tadashi Inaba, Kanagawa (JP)

(73) Assignee: Fuji Photo Film, Co., Ltd., Kanagawa (JP)

( * ) Notice: Subject to any disclaimer, the term of this patent is extended or adjusted under 35 U.S.C. 154(b) by 0 days.

(21) Appl. No.: 10/355,291

(22) Filed: Jan. 31, 2003

(65) Prior Publication Data

US 2003/0186179 A1 Oct. 2, 2003

(30) Foreign Application Priority Data

Feb. 14, 2002 (JP) ..... P.2002-036604

(51) Int. Cl.[7] ..... G03C 1/06; G03C 1/005; G03C 1/494

(52) U.S. Cl. ..... 430/604; 430/567; 430/599; 430/600; 430/605

(58) Field of Search ..... 430/567, 599, 430/600, 604, 605

(56) References Cited

U.S. PATENT DOCUMENTS 3,672,901 A 6/1972 Ohkubo et al.
5,360,712 A 11/1994 Olm et al.
5,821,044 A * 10/1998 Bergthaller et al. ..... 430/604
6,335,154 B1 * 1/2002 Asami et al. ..... 430/605
6,352,823 B1 * 3/2002 Sato ..... 430/605
6,372,419 B1 * 4/2002 Inaba et al. ..... 430/605
6,403,294 B2 * 6/2002 Sato ..... 430/604

OTHER PUBLICATIONS

Joe E. Maskasky, In Corporation of Spectral Sensitizing Dyes into Large AgBr Crystals, Photogr. Sci. Eng., 28, 202–207 (1984).

Joe E. Maskasky and Michael Haley, Observations on the Orthorhombic PbO Spectral Sensitization of AgCI, Photogr. Sci. Eng., 25, 225–229 (1981).

* cited by examiner

*Primary Examiner*—Geraldine Letscher
(74) *Attorney, Agent, or Firm*—Sughrue Mion, PLLC

(57) ABSTRACT

A light-sensitive silver halide grain having an absorption band in a wavelength region of visible light is prepared to provide a silver halide photographic material having high spectral sensitivity in the visible region. The silver halide photographic material contains the light-sensitive silver halide grain having a metal complex dopant having an absorption band which has a molar absorption coefficient of 10,000 or more in a wavelength region of visible light in an ultraviolet-visible absorption spectrum of a solution thereof.

6 Claims, No Drawings

LIGHT-SENSITIVE SILVER HALIDE GRAIN

FIELD OF THE INVENTION

The present invention relates to a light-sensitive silver halide grain used in a silver halide photographic material, and particularly to a high-sensitive silver halide photographic emulsion using dopant technology.

BACKGROUND OF THE INVENTION

There is dopant technology as one of techniques for sensitizing silver halide photographic materials. The term "dopant technology" means a technique of incorporating materials other than silver ions and halide ions (dopants) into silver halide grains (doping technology). This technology allows transition metal ions to be introduced into the silver halide grains. Even though the amount of the transition metal ions introduced is extremely slight, compared with the amount of the silver ion constituting the silver halide grains, it has generally been observed that the transition metal ions effectively change the properties of photographic emulsions containing the silver halide grains doped.

In order to more enhance the sensitivity of the silver halide emulsion by the doping technology, it is most effective to dope the silver halide grain with not only a bare transition metal ion but also a "hexacyano complex" having a transition metal ion as a central metal and 6 ligands as cyanide ions. In particular, many examples of highly sensitized emulsions obtained by doping the silver halide grains with the group VIII metal ions are disclosed. Japanese Patent Publication No. 35373/1973 discloses hexacyanoferrate (II) complexes and hexacyanoferrate (III) complexes as dopants containing cyanide ions, but it discloses that the effect of high sensitization is limited to the case that iron ions are contained, regardless of the kind of ligand. However, it is shown that the use of cyanide ions as ligands is an effective means for obtaining highly sensitized emulsions, as described, for example, in Japanese Patent (Application) Laid-Open No. 66511/1993, U.S. Pat. No. 5,132,203, European Patents 0336425 and 0336426, and Japanese Patent Laid-Open No. 20854/1990. Central metals used in these disclosed examples include iron, rhenium, ruthenium, osmium and iridium. Further, an example of the use of cobalt (III) is disclosed in U.S. Pat. No. 3,790,390, and an example of the use of rhodium (III) is disclosed in U.S. Pat. No. 4,847,191. On the other hand, as highly sensitized emulsions obtained by doping with complexes having ligands other than the cyanide ions, U.S. Pat. No. 2,448,060 discloses that an emulsion doped with a complex of platinum (II) or palladium (IV) having a halogen ion as a ligand is sensitized, Japanese Patent Laid-Open No. 118535/1991 discloses sensitization by doping with a transition metal complex in which one ligand of a six-coordinated metal complex is carbonyl, and Japanese Patent Laid-Open No. 118536/1991 discloses that the internal sensitivity of an emulsion containing a transition metal complex in the inside thereof in which two ligands of a six-coordinated metal complex are oxygen increases. Further, examples of highly sensitized emulsions obtained by doping with complexes having organic compounds as ligands are also known. Japanese Patent Laid-Open No. 38249/1969 and U.S. Pat. No. 3,672,901 disclose examples of highly sensitized emulsions obtained by doping with iron complexes having organic compounds including $[Fe(EDTA)]^{2-}$ (EDTA= ethylenediaminetetraacetic acid) as ligands, and Japanese Patent Laid-Open No. 259749/1990 discloses examples of highly sensitized emulsions obtained by doping with $[Fe(C_2O_4)_3]^{3-}$. U.S. Pat. Nos. 5,360,712, 5,457,021 and 5,462,849, European Patent 0709724, and Japanese Patent Laid-Open Nos. 72569/1995 and 179452/1996 discloses examples of the use of complexes having many organic compounds as ligands. It is described that the effect of sensitization is significant particularly in doping with $[(NC)_5Fe(m\text{-}4,4'\text{-bipyridine})Fe(CN)_5]^{6-}$. In Japanese Patent Laid-Open No. 24194/1999, an emulsion high in sensitivity and improved in reciprocity failure is obtained by doping with $[Fe(CO)_4(P(Ph)_3)]^0$ or $[Fe(CO)_3(P(Ph)_2)]^0$. Further, according to Japanese Patent Laid-Open No. 102042/1999, an emulsion having high sensitivity is obtained when 2-mercaptobenzimidazole, 5-methyl-s-triazolo(1.5-A) pyrimidine-7-ol or 2-mercapto-1,3,4-oxadiazole is used as L in an $[M(CN)_5L]^{3-}$ ($M=Fe^{2+}$, $Ru^{2+}$, $Ir^{3+}$), $[Fe(CO)_4L]^0$, $[M'(CN)_3L]^-$ ($M'=Pd^{2+}$, $Pt^{2+}$) or $[IrCl_5L]^{2-}$ type complex. Furthermore, Japanese Patent Laid-Open No. 341426/1993 discloses emulsions to which some complexes including $[Ru(bpy)_2Cl_2]^0$ (bpy=2,2'-bipyridine) are added. However, it discloses that the effect at the time when these complexes are added during the formation of grains is not so much, and that the significant effect is obtained by adding the complexes to grain surfaces together with dyes after the formation of grains.

In addition to the above, as examples in which transition metal complexes are added to grain surfaces, not as dopants, as described in Japanese Patent Laid-Open No. 341426/1993, to play a spectral sensitizing dye role, iron and molybdenum complexes of cyclopentadiene are each disclosed in U.S. Pat. No. 5,457,022 and German Patent 19629981, respectively. However, in either case, the inside of the grains is not doped with the complex, and the silver halide grains themselves are not allowed to have spectral (sensitizing) sensitivity. Examples in which silver halide grains themselves can have absorption bands in a wavelength region of visible light are described in *Photogr. Sci. Eng.*, 28, 202 (1984) in which spectral sensitizing dyes are incorporated into silver halide grains, and *Photogr. Sci. Eng.*, 25, 225 (1981) in which silver halide grains having spectral (sensitizing) sensitivity are obtained by coating PbO grains with AgCl. However, in these processes, the silver halide grains are obtained by the diffusion processor by coating of inorganic crystals with a silver halide, and these processes are largely different from the usual preparation processes of silver halide emulsions. Accordingly, such emulsions can not be easily used as actual silver halide photographic materials.

SUMMARY OF THE INVENTION

An object of the present invention is to prepare a silver halide grain having an absorption band in a wavelength region of visible light, and therefore provide a silver halide photographic material having high spectral sensitivity.

The object of the present invention has been attained by the following means:

(1) A light-sensitive silver halide grain comprising a metal complex dopant having an absorption band which has a molar absorption coefficient of 10,000 or more in a wavelength region of visible light in an ultraviolet-visible absorption spectrum of a solution thereof;

(2) A silver halide emulsion containing a silver halide grain, wherein the silver halide grain comprises a metal complex dopant having an absorption band which has a molar absorption coefficient of 10,000 or more in a wavelength region of visible light in an ultraviolet-visible absorption spectrum;

(3) The silver halide grain described in (1) or the silver halide emulsion described in (2), wherein the metal complex dopant contained in the silver halide grain has an absorption band having a molar absorption coefficient of 10,000 or more between wavelengths of 380 nm and 780 nm;

(4) The silver halide grain described in (1), the silver halide emulsion described in (2) or the silver halide grain or silver halide emulsion described in (3), wherein the metal complex dopant contained in the silver halide grain has at least one heterocyclic compound as a ligand;

(5) The silver halide grain described in (1), the silver halide emulsion described in (2) or the silver halide grain or silver halide emulsion described in (3) or (4), wherein the number of inorganic anions coordinating to a central metal in the metal complex dopant contained in the silver halide grain does not exceed the majority of the coordination number of the complex;

(6) The silver halide grain described in (1), the silver halide emulsion described in (2) or the silver halide grain or silver halide emulsion described in any one of (3) to (5), wherein the majority of coordination sites of the central metal of the metal complex dopant contained in the silver halide grain are occupied by heterocyclic compounds;

(7) The silver halide grain described in (1), the silver halide emulsion described in (2) or the silver halide grain or silver halide emulsion described in any one of (3) to (6), wherein the central metal of the metal complex dopant contained in the silver halide grain is a metal or a metal ion selected from the group consisting of iron, cobalt, nickel, copper and ruthenium; and (8) A silver halide photographic material comprising a support having thereon at least one silver halide emulsion layer, wherein a silver halide grain contained in the emulsion comprises a metal complex dopant having an absorption band which has a molar absorption coefficient of 10,000 or more in a wavelength region of visible light in an ultraviolet-visible absorption spectrum of a solution thereof.

DETAILED DESCRIPTION OF THE INVENTION

As shown in *Bulgarian Chem. Commun.,* 20, 350–368 (1993), *Raiat. Eff. Defects Solids,* 135, 101–104 (1995) and *J. Phys.: Condens Matter,* 9, 3227–3240 (1997), doping with a hexacyano complex results in the introduction of a shallow electron trap into the silver halide grain by a coulomb field. In particular, when a divalent metal ion such as $Fe^{2+}$ or $Ru^{2+}$ is used as the central metal as shown in ICPS, Final Program and Proceedings, Vol. 1, p. 89 (1998), ICPS, Final Program and Proceedings, Vol. 1, p. 92 (1998) and Japanese Patent Laid-Open No. 286306/1996, a photoelectron trap having an appropriate depth caused by the coulomb field is introduced by introducing an excess charge of +1 into an environment in the grain comprising $Ag^+$ and $Cl^-$, thereby prolonging the time required until a photoelectron generated by exposure is inactivated to significantly increase photographic sensitivity. At this time, the cyanide ion used as the ligand brings about a strong ligand field effect. That is to say, donation (back donation) of the electron from the metal to the ligand forms a $\pi$ bond, and this $\pi$ bond causes further stabilization of a $t_{2g}$ orbital, shortening of metal-ligand distance and an increase in effective positive charge of the metal ion, thereby giving the effect of greatly increasing disruption of a d orbital of the metal. This effect allows an $e_g$ orbital of the complex used for doping (which becomes the lowest unoccupied molecular orbital) to have energy higher than the bottom of a conduction band of the silver halide, resulting in a level independent of capture of the photoelectron. The shallow electron trap caused by the coulomb field can be first made up in the vicinity of the dopant thereby. In order to utilize this mechanism, the "hexacyano complex" has hitherto been used as the highly sensitized dopant in most cases.

On the other hand, as a high sensitizing method using a dopant other than the method providing the shallow electron trap, there is a method having the function of temporarily capturing a light positive hole developed by light irradiation to a silver halide to decrease recombination with a photoelectron. $[RuCl_5(CO)]^{3-}$ described in Japanese Patent Laid-Open No. 118535/1991 corresponds thereto. Further, as one which brings about high sensitization using the mechanism of releasing a secondary electron by a captured positive hole, there is formic acid described in Japanese Patent Laid-Open No. 237710/1999. Dopants having functions other than those of the electron and positive hole traps are scarcely known. However, it is also considered to be one function to be achieved by dopants to obtain silver halide grains having sensitivity in a region of visible light and silver halide emulsions highly sensitized thereby, by doping with the dopants having a very high molar absorption coefficient in the wavelength region of visible light in which the silver halide grains does not have sensitivity, particularly in a wavelength region of longer than 500 nm.

When the inside of the silver halide grains is doped with the metal complex dopant (hereinafter also referred to as the "metal complex" or the "complex") having a high molar absorption coefficient, it is not easy that the complex has light absorption as high as when it is on the outside of the grains, considering the relationship between a band structure of the silver halide and an energy level of the complex. However, in the present invention, it has been discovered that an absorption band considered to be derived from the complex used for doping can be observed, although a shift is observed in the absorption wavelength in some complexes having heterocyclic compounds as ligands.

The absorption band of the transition metal complex observed in the vicinity of the wavelength of visible light belongs to any one of "a transition from a d orbital to a d orbital in a central metal", "a transition from a d orbital of a central metal to a $\pi^*$ orbital of a ligand" and "a transition from a $\pi$ orbital of a ligand to a $\pi^*$ orbital". In general, the molar absorption coefficient of the absorption band derived from each of these transitions is from several tens to hundreds for "the transition from a d orbital to a d orbital in a central metal", thousands for "the transition from a d orbital of a central metal to a $\pi^*$ orbital of a ligand", and thousands or more for "the transition from a $\pi$ orbital of a ligand to a $\pi^*$ orbital". Considering this, the transition effectively utilizable for improvements in sensitivity of the silver halide grains in the present invention is "the transition from a d orbital of a central metal to a $\pi^*$ orbital of a ligand" or "the transition from a $\pi$ orbital of a ligand to a $\pi^*$ orbital". The type of each of these transitions can be anticipated from the luminous life of each complex. These transitions to which the $\pi^*$ orbital is related are required, so that the complexes used in the present invention can be said to be complexes having heterocyclic compounds as ligands. In these complexes, no notice is taken of the number of the heterocyclic compounds or ligands. However, considering the transition probability from the symmetry of a molecular orbital of the complex, the number of inorganic anions as ligands is preferably not so much, and the complexes having the heterocyclic compounds as main ligands are preferred. The term "inorganic anion" used in the present invention means an anion having no carbon-carbon bond and no carbon-hydrogen bond at all.

The heterocyclic compound used in the present invention preferably coordinates to the metal ion through a heteroatom. Above all, it is preferred that the compound has a π conjugated system in the vicinity of a coordination atom, or aromaticity. Of the heterocyclic compounds, a 5-membered or 6-membered cyclic compound is preferred, and the compound having a nitrogen atom, an oxygen atom or a sulfur atom as a heteroatom is more preferred.

Preferred specific examples of the compounds include furan, thiophene, pyrrole, oxazoline, oxazole, isooxazole, thiazoline, thiazole, isothiazole, thiadiazole, imidazole, pyrazole, triazole, tetrazole, furazan, pyran, pyridine, pyridazine, pyrimidine, pyrazine, triazine, oxadiazine, thiadiazine, imidazoline, pyrazoline and derivatives thereof. Compounds in which two or more of these heterocyclic compounds are connected are also preferred. Of these, preferred are 2,2'-bithiophene, 2,2'-bipyridine, 2,2'-biquinoline, 1,10-phenanthroline, 2,2':5',2"-terthiophene and 2,2':6',2"-terpyridine. On the other hand, a compound is also preferred which coordinates to the metal through a substituent group combined with a heterocyclic skeleton (i.e., a heterocyclic basic structure), and further, a compound is also preferred which has a substituent group combined with a ring skeleton (i.e., a ring basic strucute), in addition to the substituent group combined with the metal.

Preferred specific examples of the substituent groups contained in the compounds which coordinate to the metals include a hydrogen atom, a substituted or unsubstituted alkyl group (for example, methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl or methanesulfonylaminomethyl), an alkenyl group, an alkynyl group, an aralkyl group, a cycloalkyl group (for example, cyclohexyl or 4-t-butylcyclohexyl), a substituted or unsubstituted aryl group (for example, phenyl, p-tolyl, p-anisyl, p-chlorophenyl, 4-t-butylpheny or 2,4-di-t-aminophenyl), a halogen atom (for example, fluorine, chlorine, bromine or iodine), a cyano group, a nitro group, a mercapto group, a hydroxyl group, an alkoxyl group (for example, methoxy, butoxy, methoxyethoxy, dodecyloxy or 2-ethylhexyloxy), an aryloxy group (for example, phenoxy, p-tolyloxy, p-chlorophenoxy or 4-t-butylphenoxy), an alkylthio group, an arylthio group, an acyloxy group, an sulfonyloxy group, a substituted or unsubstituted amino group (for example, amino, methylamino, dimethylamino, anilino or N-methylanilino), an ammonio group, a carbonamido group, a sulfonamido group, an oxycarbonylamino group, an oxysulfonylamino group, a substituted ureido group (for example, 3-methylureido, 3-phenylureido or 3,3-dibutylureido), a thioureido group, an acyl group (for example, formyl oracetyl), an oxycarbonyl group, a substituted or unsubstituted carbamoyl group (ethylcarbamoyl dibutylcarbamoyl, dodecyloxypropylcarbamoyl, 3-(2,4-di-t-aminophenoxy)-propylcarbamoyl, piperidinocarbonyl or morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid or a salt thereof, a sulfonic acid or a salt thereof, and a phosphonic acid or a salt thereof it is also preferred that the substituent groups adjacent to each other are subjected to ring closure to form a saturated carbon ring, an aromatic carbon ring or a heteroaromatic ring.

The central metal of the complex used as the dopant in the present invention is preferably a metal forming an octahedral six-coordinated structure. Further, considering a structure at the time when the complex is incorporated in the silver halide grain, a metal or a metal ion forming a complex of a square planar structure is also preferred. A metal is more preferred in which all orbitals to be stabilized are filled with electrons when ligand field splitting occurs in the d orbital of the metal. Further, a metal or a metal ion having no unpaired electron is also preferred, and most preferred is a metal or a metal ion having no unpaired electron in which all orbitals to be stabilized are filled with electrons when ligand field splitting occurs in the d orbital of the metal. Preferred specific examples of the metals include metal ions of an alkali earth metal, iron, ruthenium, manganese, cobalt, rhodium, iridium, copper, nickel, palladium, platinum, gold, zinc, titanium, chromium, osmium, cadmium and mercury. Above all, particularly preferred are iron, ruthenium, manganese, cobalt, nickel, copper, rhodium, iridium, titanium, chromium and osmium, and most preferred are ions of iron, cobalt, nickel, copper and ruthenium.

The molar absorption coefficient is defined as described below. Assuming that light having a intensity I passes through a tabular material having a thickness dx and at that time, the material contains a component absorbing the light at a concentration C, $d\ln I=-\alpha C dx$ is given, wherein a is taken as a coefficient depending on frequencies of an intended molecule and the light. When the incident intensity is $I_i$, the intensity $I_f$ of light passing through a sample having a thickness of 1 is expressed by the following equation:

$$\int_{I_i}^{I_f} d\ln I = -\int_0^l \alpha C dx.$$

When the concentration of the component contained in the sample is even, C does not depend on x. Accordingly, the integration of the above equation gives $I_f=I_i \exp(-\alpha Cl)$. At this time, assuming $\epsilon=\alpha/2.303$, the following equation is given:

$$\log(I_f-I_i)=-\epsilon Cl$$

ε in this equation is taken as the molar absorption coefficient. In the present invention, the integral absorption coefficient taking the sum of absorption coefficients to all oscillators in an absorption band was not used, and the maximum value of the molar absorption coefficient of the absorption band was taken as ε. Actually, taking εCl as the absorbance A of the sample, the absorbance of a solution thereof was measured using a Hitachi U-3400 spectrophotometer, thereby determining ε from the concentration of the complex and the cell length.

Examples of the complexes used as the dopants used in the present invention and the molar absorption coefficients thereof are shown below, but the compounds used in the present invention are not limited thereto.

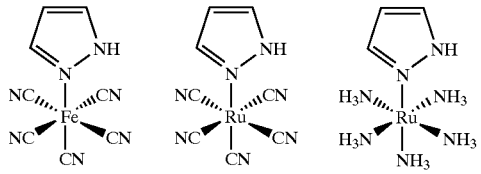

ε; 16,000 (at 625 nm) ε; 20,400 (at 490 nm) ε; 21,400 (at 472 nm)

-continued
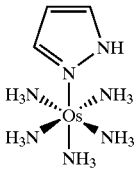
ε; 21,700
(at 460 nm)
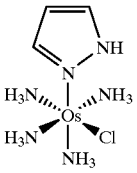
ε; 21,500
(at 465 nm)
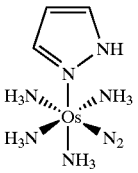
ε; 22,300
(at 430 nm)
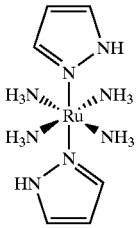
ε; 21,877
(at 486 nm)
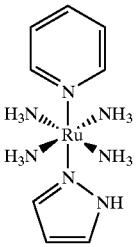
ε; 18,620
(at 474 nm)
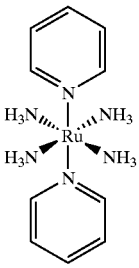
ε; 16,982
(at 423 nm)
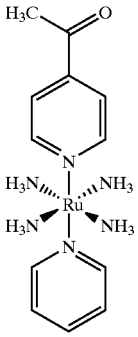
ε; 16,218
(at 508 nm)
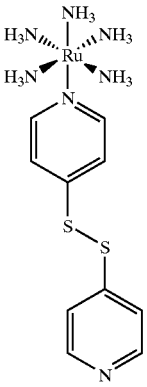
ε; 13,000
(at 459 nm)
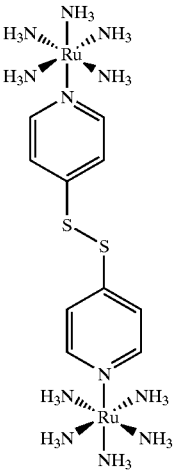
ε; 19,000
(at 466 nm)
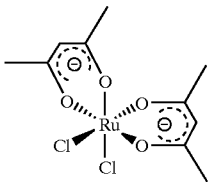
ε; 25,400
(at 724 nm)
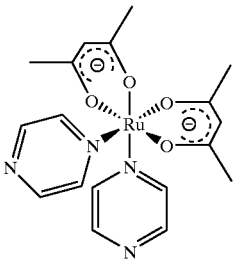
ε; 10,400
(at 524 nm)
-continued
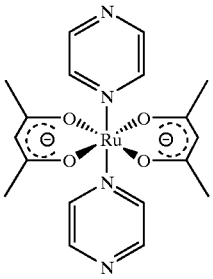
ε; 14,000
(at 567 nm)
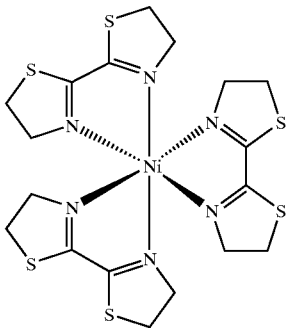
ε; 13,000
(at 538 nm)
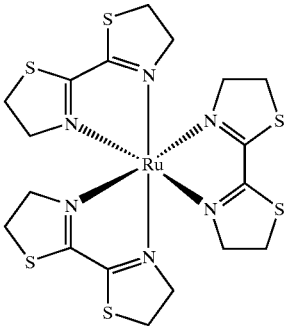
ε; 16,600
(at 515 nm)
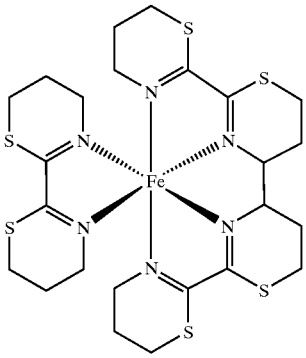
ε; 10,100
(at 606 nm)
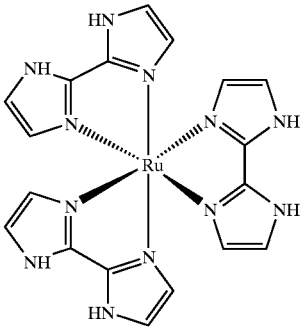
ε; 12,000
(at 401 nm)

-continued
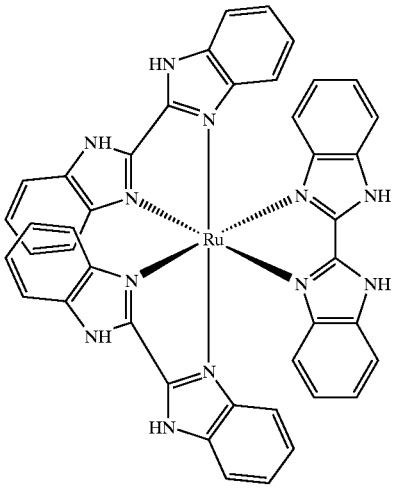
ε; 43,000
(at 498 nm)
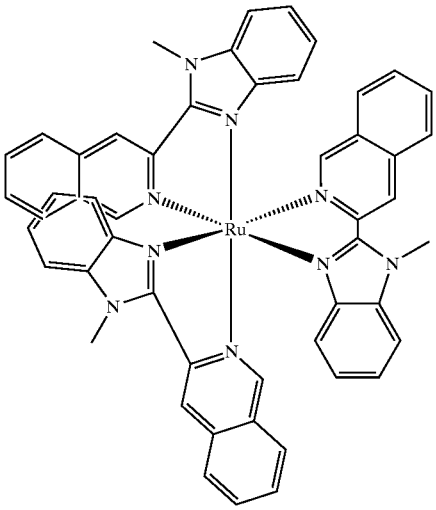
ε; 11,500
(at 520 nm)
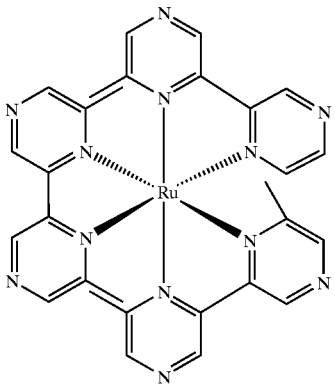
ε; 10,700
(at 507 nm)
-continued
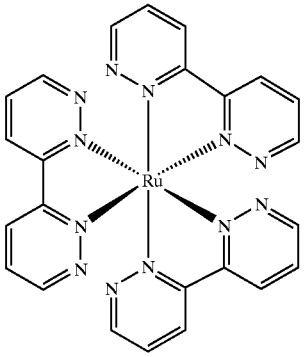
ε; 11,500
(at 444 nm)
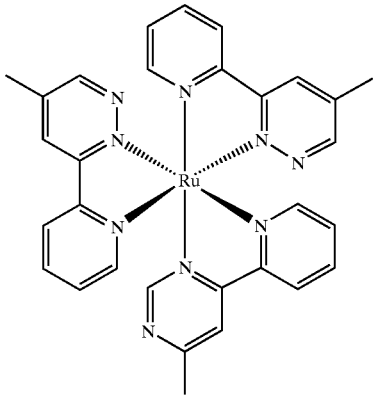
ε; 10,200
(at 452 nm)
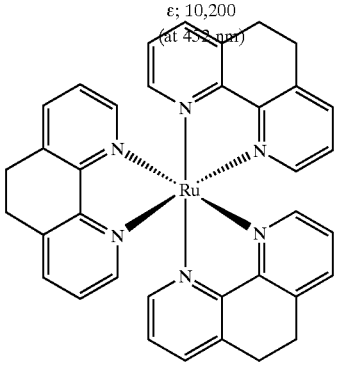
ε; 14,700
(at 453 nm)
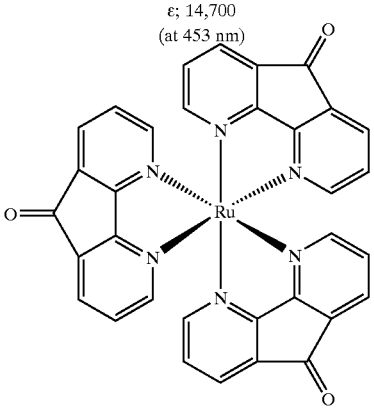
ε; 13,500
(at 498 nm)

-continued
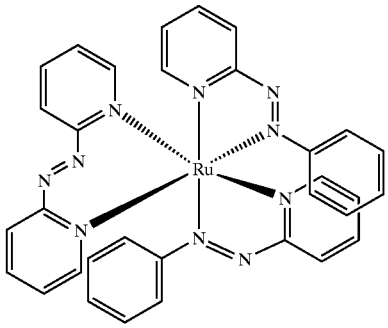
ε; 12,200
(at 623 nm)
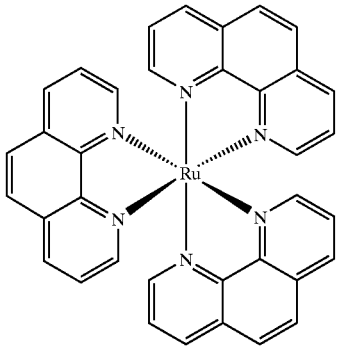
ε; 17,300
(at 448 nm)
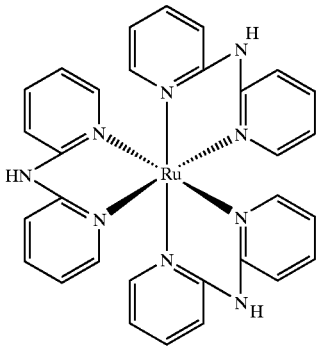
ε; 14,000
(at 422 nm)
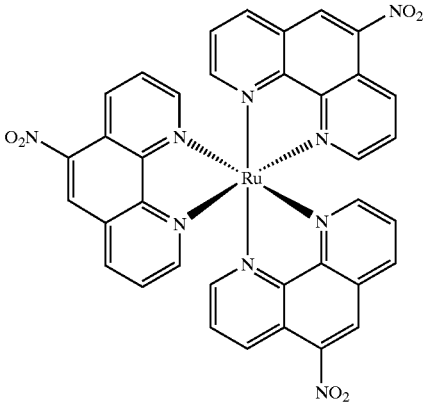
ε; 19,400
(at 445 nm)
-continued
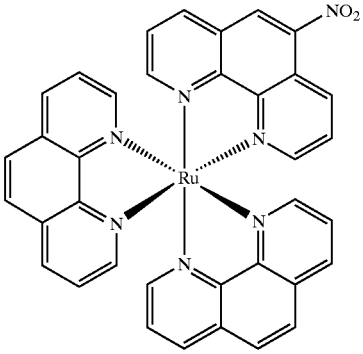
ε; 18,300
(at 445 nm)
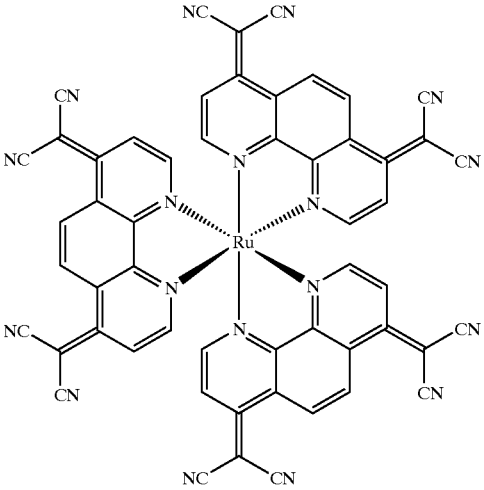
ε; 50,118
(at 502 nm)
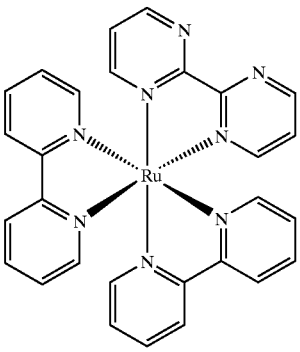
ε; 11,300
(at 475 nm)

-continued
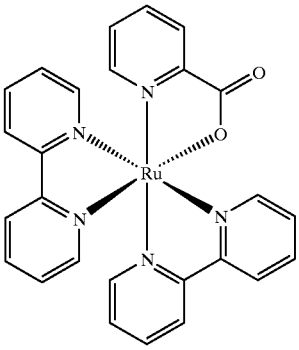
ε; 12,000
(at 468 nm)
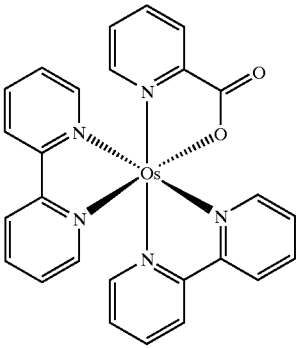
ε; 14,000
(at 480 nm)
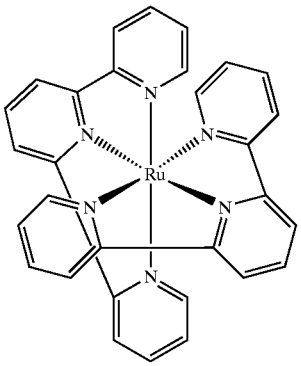
ε; 16,200
(at 473 nm)
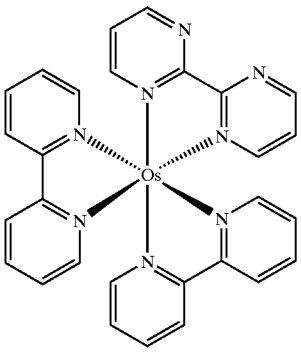
ε; 13,000
(at 455 nm)
-continued
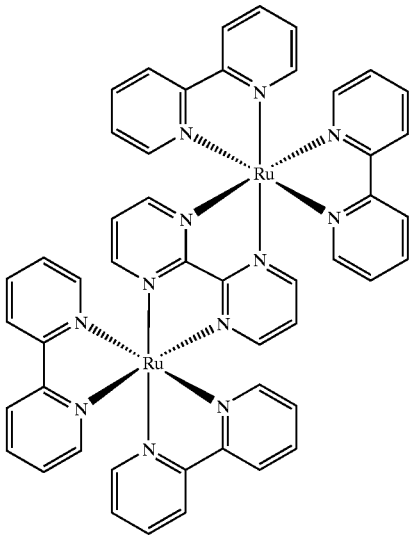
ε; 31,300
(at 560 nm)
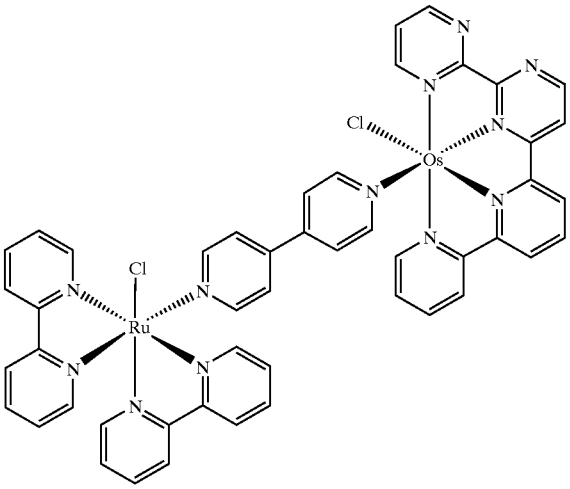
ε; 28,000
(at 520 nm)
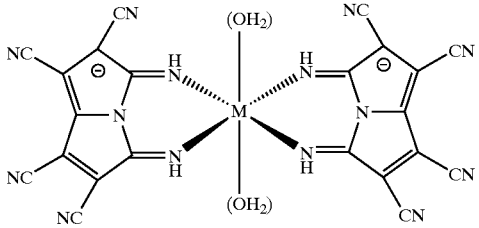
M = Fe ε; 50,000 (at 630 nm)
Co ε; 84,000 (at 640 nm)
Ni ε; 103,000 (at 660 nm)
Cu ε; 54,000 (at 646 nm)
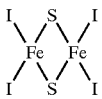
ε; 11,600
(at 409 nm)
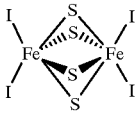
ε; 16,000
(at 390 nm)

-continued

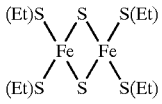

ε; 10,100
(at 427 nm)

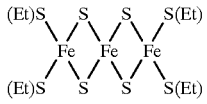

ε; 14,800
(at 511 nm)

In the present invention, when the complex molecule used for doping is a cation, and forms a salt with an anion, a counter anion thereto is preferably one easily soluble in water and suitable for a precipitation operation of the silver halide emulsion. Specifically, a halogen ion, a nitrate ion, a perchlorate ion, a tetrafluoroborate ion, a hexafluorophosphate ion, tetraphenylborate ion, a hexafluorosilicate ion and a trifluoromethanesulfonate ion are preferably used. In addition, when an anion strong in coordination ability such as a cyano ion, a thiocyano ion, a nitrite ion or an oxalate is used as the counter ion, there is a possibility that it causes the ligand exchange reaction with a ligand of the complex, resulting in failure to maintain the composition and structure of the complex used in the present invention. It is therefore unfavorable to use such an anion. Further, when a ligand in the complex is negatively charged by elimination of $H^+$ to allow the complex molecule to become an anion, an alkali metal ion such as a sodium ion, a potassium ion, a rubidium ion or a cesium ion, an ammonium ion or a quaternary alkylammonium ion which is easily soluble in water and suitable for a precipitation operation of the silver halide emulsion is preferably used as a counter cation thereto. As an alkyl group of the quaternary alkylammonium ion, preferred is methyl, ethyl, propyl, iso-propyl or n-butyl. Above all, a tetramethylammonium ion, a tetraethylammonium ion, a tetrapropylammonium ion or a tetra(n-butyl)ammonium ion, in which four substituent groups are all the same, is preferred.

The complexes used in the present invention can be synthesized by methods reported in literature (for example, *Inorg. Chem.,* 22, 1117 (1983), *Inorg. Chem.,* 30, 2925 (1991), *J. Chem. Soc. Dalton Trans.,* 1292 (1976) and *Transition Met. Chem.,* 18, 197 (1993)).

The complex used in the present invention is preferably added to the silver halide grain by directly adding the complex to a reaction solution in forming the silver halide grain, or adding the complex to an aqueous solution of a halide for forming the silver halide grain or a solution other than that, thereby adding the complex to a grain forming reaction solution. Further, the silver halide grain may be doped by a combination of these methods.

When the silver halide grain is doped with the complex used in the present invention, the complex may be allowed to exist homogeneously in the inside of the grain, or only in a surface layer of the grain as disclosed in Japanese Patent Laid-Open Nos. 208936/1992, 125245/1990 and 188437/1991. Further, only the inside of the grain may be doped with the complex, and a layer not doped may be added to the surface of the grain. In the present invention, it is preferred that the grain is doped in such a way that the complex molecule is not exposed on the surface of the grain. A doped fine grain may be subjected to physical ripening to improve a surface phase of the grain, as disclosed in U.S. Pat. Nos. 5,252,451 and 5,256,530. Further, a method is also preferred in which a fine grain doped with the complex is prepared, and the resulting fine grain is added and subjected to physical ripening, thereby doping the silver halide grain with the complex. Furthermore, the above-mentioned doping methods may be used in combination.

The doping amount of the complex is suitably from $1\times10^{-9}$ mol to $1\times10^{-2}$ mol, and preferably from $1\times10^{-7}$ mol to $1\times10^{-3}$ mol, per mol of silver halide.

There is no particular limitation on the silver halide contained in the silver halide emulsion used in the silver halide photographic material of the present invention, and silver chloride, silver, chlorobromide, silver bromide, silver iodochloride or silver iodobromide can be used. However, a silver halide emulsion containing a bromide ion or an iodide ion is more preferred than a pure silver halide emulsion. Although there is no particular limitation on the size of the silver halide grain, the grain having a sphere-corresponding diameter of from 0.01 to 3 $\mu$m is preferred. The silver halide grain may be in a regular crystal form (normal crystal grain) or in an irregular crystal form. However, the normal crystal grain is more preferred. The normal crystal grains include cubic, octahedral, dodecahedral, tetradecahedral, eicosahedral and octatetracontahedral grains. The irregular crystal grains include spherical and pebble-like grains. A grain having one or more twin crystal planes may be used for doping with the complex used in the present invention, and a rectangular tabular grain and a triangular tabular grain each having two or three parallel twin crystal planes are preferably used. Further, in the tabular grains, it is more preferred that the grain size distribution thereof is monodisperse. The preparation of the tabular monodisperse grains is described in Japanese Patent Laid-Open No. 11928/1988. A hexagonal tabular monodisperse grain is described in Japanese Patent Laid-Open No. 151618/1988. A circular tabular monodisperse emulsion is described in Japanese Patent Laid-Open No. 131541/1989. Further, Japanese Patent Laid-Open No. 838/1990 discloses an emulsion in which tabular grains each having two twin crystal planes parallel to a main plane occupy 95% or more of the total projected area, and the size distribution of the tabular grains is monodisperse. EP-A-514742 discloses a tabular grain emulsion prepared by using a polyalkylene oxide block polymer, in which the coefficient of variation of the grain size is 10% or less. The use of these techniques makes it possible to prepare monodisperse grains preferred in the present invention.

As the tabular grains, there are known one whose main plane is a (100) plane and one whose main plain is a (111) plane. The former is described in U.S. Pat. No. 4,063,951 and Japanese Patent Laid-Open No. 281640/1993 for silver bromide, and in EP-A-0534395 and U.S. Pat. No. 5,264,337 for silver chloride. The latter tabular grain is a grain having one or more of the above-mentioned twin planes and various form, and is described in U.S. Pat. Nos. 4,399,215, 4,983,508 and 5,183,732, and Japanese Patent Laid-Open Nos. 137632/1991 and 116113/1991 for silver chloride. The dopant used in the present invention can be preferably adapted to both the tabular grain whose main plain is a (100) plane and the tabular grain whose main plain is a (111) plane.

The silver halide grain may have a dislocation line in the grain. A technique for introducing the dislocation line into the silver halide grain under control is described in Japanese Patent Laid-Open No. 220238/1988. According to this patent, dislocation can be introduced by forming a specific high iodine phase in the inside of the tabular silver halide grain having an average grain size/grain thickness ratio of 2 or more, and covering the outside thereof with a phase having a iodine content lower than the high iodine phase. This introduction of dislocation can give the effects of increasing sensitivity, improving keeping quality, improving latent image stability and decreasing pressure marks. According to the present invention described in this patent, dislocation is mainly introduced into an edge portion of the tabular grain. Further, a tabular grain in which dislocation is introduced into a center portion is described in U.S. Pat. No. 5,238,796. Furthermore, a normal crystal grain having dislocation in the inside thereof is disclosed in Japanese Patent Laid-Open No. 348337/1992. This patent discloses that dislocation can be introduced by forming epitaxy of silver chloride or silver chlorobromide in the normal crystal grain, and subjecting the epitaxy to physical ripening and/or conversion by halogen. Dislocation can be introduced into the silver halide grain in the present invention by both the method of forming the high iodine phase and the method of forming the epitaxy of silver chlorobromide. Such introduction of dislocation gives the effects of increasing sensitivity and decreasing pressure marks. The dislocation lines in the silver halide grains can be observed by a direct method using a transmission electron microscope at low temperature, which is described, for example, in J. F. Hamilton, *Photo. Sci. Eng.,* 11, 57 (1967) and T. Shiozawa, *J. Soc. Photo Sci. JAPAN,* 35, 213 (1972). That is to say, the silver halide grains carefully taken out of the emulsion so as not to apply such pressure that dislocation occurs is placed on a mesh for observation under an electron microscope, and observed in a state where the sample is cooled so as to prevent damage (print out) caused by an electron beam. At this time, the thicker the thickness of the grain is, the more difficult it becomes that the electron beam passes through the grain. Accordingly, the use of a high-voltage type (200 kV or more to a thickness of 0.25 $\mu$m) electron microscope allows clearer observation. From a photograph of the grains obtained by such a method, the position and number of dislocation lines can be determined for each grain observed from a plane perpendicular to a main plane. The present invention is effective when 50% or more of the silver halide grains contain 10 or more dislocation lines per grain.

In the preparation of the silver halide emulsion, there is no particular limitation on an additive which can be added in the processes from grain formation to coating. In order to enhance the growth of crystals in the course of crystal formation, and in order to make chemical sensitization effective in grain formation and/or chemical sensitization, a solvent for silver halide can be used. As the solvents for silver halide, water-soluble thiocyanates, ammonia, thioethers and thiourea compounds are preferably available. Examples of the solvents for silver halide include thiocyanates (described in U.S. Pat. Nos. 2,222,264, 2,448,534 and 3,320,069), ammonia, thioether compounds (described in U.S. Pat. Nos. 3,271,157, 3,574,628, 3,704,130, 4,297,439 and 4,276,347), thione compounds (described in Japanese Patent Laid-Open Nos. 144319/1978, 82408/1978 and 77737/1980) amine compounds (described in Japanese Patent Laid-Open No. 100717/1979), thiourea derivatives (described in Japanese Patent Laid-Open No. 2982/1980), imidazole compounds (described in Japanese Patent Laid-Open No. 100717/1979) and substituted mercaptotetrazole compounds (described in Japanese Patent Laid-Open No. 202531/1982).

There is no particular limitation on a method for producing the silver halide emulsion. In general, an aqueous silver salt solution and an aqueous halogen salt solution are added to a reaction solution having an aqueous gelatin solution with effective stirring. Specifically, the emulsion can be prepared by using methods described in P. Glafkides, "Chimie et Phisique Photographique" (Paul Montel, 1967), G. F. Duffin, "Photographic Emulsion Chemistry" (The Focal Press, 1966) and V. L. Zelikman et al., "Making and Coating Photographic Emulsion" (The Focal Press, 1964). That is to say, any of an acid process, a neutral process and an ammonia process may be used. A soluble silver salt and a soluble halogen salt may be reacted with each other by using any of a single jet process, a double jet process and a combination thereof. As a type of double jet process, a process of maintaining the pAg in a liquid phase constant in which a silver halide is formed, that is to say, a so-called controlled double jet process, can be preferably used in the present invention. It is preferred that the grains are allowed to grow rapidly within the range not exceeding the degree of critical supersaturation by a method of changing the addition rates of silver nitrate and an aqueous alkali halide solution according to the rate of grain growth (described in British Patent 1,535,016 and Japanese Patent Publication Nos. 36890/1973 and 16364/1977) or a method of changing the concentrations of the aqueous solutions (described in U.S. Pat. No. 4,242,445 and Japanese Patent Laid-Open No. 158124/1980). These methods can be preferably used, because re-nucleation does not occur and the silver halide grains grow uniformly.

It is also preferable to use a method for obtaining the silver halide grains by adding fine grains previously prepared into a reaction vessel to induce nucleation and/or grain growth in place of adding the silver salt solution and the halogen solution to the reaction vessel. This technology is described in Japanese Patent Laid-Open Nos. 183644/1989, 183645/1989, 44335/1990, 43534/1990 and 43535/1990 and U.S. Pat. No. 4,879,208. According to this method, the distribution of halogen ions in an emulsion grain crystal can be made completely uniform to obtain preferred photographic characteristics. Further, in the present invention, emulsion grains having various structures can be used. So-called core/shell double structure grains comprising the inside (core portion) and the outside (shell portion), triple structure grains (described in Japanese Patent Laid-Open No. 222844/1985) and more multilayer structure grains are used. When the inside of the grain is allowed to have a structure, not only the grain having the envelopment structure as described above, but also the grain having a so-called joined structure can also be produced. Examples thereof are described in Japanese Patent Laid-Open Nos. 108526/1983, 16254/1984 and 133540/1984, Japanese Patent Publication No. 24772/1983 and EP-A-199290. A crystal to be joined to a host crystal has a composition different from that of the host crystal, and is joined to an edge, a corner portion or a face portion thereof to perform crystal growth. Such a junction crystal can be formed, even when the host crystal is homogenous with respect to the halogen composition, or has the core/shell type structure. In the case of the junction structure, a combination of silver halides with each other is naturally possible. However, when it is possible to combine a silver salt compound having no rock salt structure such as silver rhodanate or silver carbonate with a silver halide toe obtain joined grains, they may be used.

In the case of silver iodobromide grains having these structures, for example, in the core/shell type grain, the grain may be used in which the silver iodide content of the core portion is high and that of the shell portion is low, and conversely, the grain may also be used in which the silver iodide content of the core portion is low and that of the shell portion is high. Similarly, as for the grain having the junction structure, the grain may be used in which the silver iodide content of the host crystal is high and that of the junction crystal is relatively low, and the grain may also be used in which the silver iodide content is reversed. Further, in the grains having these structures, a boundary portion between different halogen compositions may be either a distinct boundary or an indistinct boundary due to the formation of a mixed crystal by the difference in composition, or a continuous change in structure may be positively given. The silver halide emulsion used in the present invention may be subjected to treatment of rounding the grains (described in EP-B-0096727 and EP-B-0064412) or surface modifying treatment (described in German Patent 2306447C2 and Japanese Patent Laid-Open No. 221320/1985). The silver halide emulsion is preferably a surface image latent type. However, an internal latent image type emulsion can also be used by selecting a developing solution or developing conditions, as disclosed in Japanese Patent Laid-Open No. 133542/1984. Further, a shallow internal latent image type emulsion in which the grains are covered with thin shells can also be used depending on the purpose.

The silver halide emulsion is usually subjected to spectral sensitization. Usually, methine dyes are preferably used as spectral sensitizing dyes. The methine dyes include cyanine dyes, merocyanine dyes, composite cyanine dyes, composite merocyanine dyes, holopolar cyanine dyes, hemicyanine dyes, styryl dyes and hemioxonol dyes. Any rings usually utilized in cyanine dyes as basic heterocyclic rings may be applied to these dyes. Examples of the basic heterocyclic rings include a pyrroline ring, an oxazoline ring, a thiazoline ring, a pyrrole ring, an oxazole ring, a thiazole ring, a selenazole ring, an imidazole ring, a tetrazole ring and a pyridine ring. Further, rings formed by condensing cyclic hydrocarbon rings or aromatic hydrocarbon rings with the heterocyclic rings can also be used. Examples of the condensed rings include an indolenine ring, a benzindolenine ring, an indole ring, a benzoxazole ring, a naphthoxazole ring, a benzothiazole ring, a naphthothiazole ring, a benzoselenazole ring, a benzimidazole ring and a quinoline ring. Substituent groups may be bonded to carbon atoms of these rings. 5-Membered or 6-membered heterocyclic rings having the ketomethylene structure can be applied to the merocyanine dyes or the composite merocyanine dyes. Examples of such heterocyclic rings include a pyrazolin-5-one ring, a thiohydantoin ring, a 2-thioxazolidin-2,4-dione ring, a thiazolidin-2,4-dione ring, a rhodanine ring and a thiobarbituric acid ring.

The amount of the sensitizing dye added is preferably from 0.001 to 100 mmol, and more preferably from 0.01 to 10 mmol, per mol of silver halide. The sensitizing dye is preferably added during chemical sensitization or before chemical sensitization (for example, in grain formation or in physical ripening).

In the present invention, the sensitivity of the silver halide grain to light having an intrinsic absorption wavelength (intrinsic sensitivity) after chemical sensitization is improved. That is to say, desensitization to light having a wavelength of longer than about 450 nm caused by adsorption of the spectral sensitizing dye onto a surface of the silver halide grain (intrinsic desensitization caused by the sensitizing dye) can be decreased by doping with each complex of the present invention. The present invention has the effect of more effectively preventing the intrinsic desensitization caused by the sensitizing dye, in addition to the effect of enhancing the intrinsic sensitivity of the silver halide.

Together with the sensitizing dye, a dye itself having no spectral sensitizing action or a substance which does not substantially absorb visible light and shows supersensitization may be added to the silver halide emulsion. Examples of such dyes or substances include aminostilben compounds substituted by nitrogen-containing heterocyclic groups (described in U.S. Pat. Nos. 2,933,390 and 3,635,721), aromatic organic acid-formaldehyde condensation products (described in U.S. Pat. No. 3,743,510), cadmium salts and azaindene compounds. Combinations of the sensitizing dyes and the above-mentioned dyes or substances are described in U.S. Pat. Nos. 3,615,613, 3,615,641, 3,617,295 and 3,635,721.

The silver halide emulsion is generally used after chemical sensitization. With respect to chemical sensitization, chalcogen sensitization (sulfur sensitization, selenium sensitization and tellurium sensitization), noble metal sensitization (for example, gold sensitization) and reduction sensitization can be conducted alone or in combination. In the present invention, chemical sensitization which is a combination of sulfur sensitization and gold sulfur sensitization is preferably used. However, selenium sensitization and tellurium sensitization are also preferably used. In sulfur sensitization, labile sulfur compounds are used as sensitizers. The labile sulfur compounds are described in P. Glafkides, "Chimie et Physique Photographique", 5th ed., Paul Montel (1987), *Research Disclosure,* 307, No. 307105, "The Theory of the Photographic Process", 4th ed., edited by T. H. James, Macmillan (1977) and H. Frieser, "Die Grundlagender Photographischen Prozess mit Silverhalogeniden", Akademishe Verlags-gesellschaft (1968). Examples of the sulfur sensitizers include thiosulfates (for example, sodium thiosulfate and p-toluene thiosulfonate), thiourea compounds (for example, diphenylthiourea, triethylthiourea, N-ethyl-N'-(4-methyl-2-thiazolyl)thiourea and carboxymethyltrimethylthiourea), thioamides (for examples, thioacetamide and N-phenylthioacetamide), rhodanine compounds (for example, rhodanine, N-ethylrhodanine, 5-benzylidenerhodanine, 5-benzylidene-N-ethylrhodanine and diethylrhodanine), phosphine sulfides (for example, trimethylphosphine sulfide), thiohydantoin compounds, 4-oxooxazolidine-2-thione compounds, dipolysulfides (for example, dimorpholine disulfide, cystine and hexathiocanethione), mercapto compounds (for example, systein), polythionates and elementary sulfur. Active gelatin can also be used as the sulfur sensitizer.

In selenium sensitization, labile selenium compounds are used as sensitizers. The labile selenium compounds are described in Japanese Patent Publication Nos. 13489/1968 and 15748/1969, and Japanese Patent Laid-Open Nos. 25832/1992, 109240/1992, 271341/1992 and 40324/1993. Examples of the selenium sensitizers include colloidal metallic selenium, selenourea compounds (for example, N,N-dimethylselenourea, trifluoromethylcarbonyltrimethylselenourea and acetyl-trimethylselenourea), selenoamides (for example, selenoacetamide and N,N-diethylphenylselenoamide), phosphine selenides (for example, triphenylphosphine selenide and pentafluorophenyltriphenylphosphine selenide), selenophosphates (for example, tri-p-tolyl selenophosphate and tri-n-butyl selenophosphate), selenoketones (for example, selenobenzophenone), isoselenocyanates, selenocarboxylic acids, selenoesters and diacyl selenides. Relatively stable selenium compounds such as selenious acid, potassium selenocyanate, selenazoles and selenides (described in Japanese Patent Publication Nos. 4553/1971 and 34492/1977) can also be utilized as the selenium sensitizers.

In tellurium sensitization, labile tellurium compounds are used as sensitizers. The labile tellurium compounds are described in Canadian Patent 800,958, British Patents 1,295,462 and 1,396,696, and Japanese Patent Laid-Open Nos. 204640/1992, 271341/1992, 333043/1992 and 303157/1993. Examples of the tellurium sensitizers include tellurourea compounds (for example, tetramethyltellurourea, N,N'-dimethylethylenetellurourea and N,N'-diphenylethylenetellurourea), phosphine tellurides (for example, butyl-diisopropylphosphine telluride, tributylphosphine telluride, tributoxyphosphine telluride and ethoxy-diphenylphosphine telluride), diacyl (di)tellurides (for example, bis(diphenylcarbamoyl)ditelluride, bis(N-phenyl-N-methylcarbamoyl)ditelluride, bis-N-phenyl-N-methylcarbamoyl)telluride and bis(ethoxycarbonyl)telluride), isotellurocyanates (for example, allyl isotellurocyanate), telluroketones (for example, telluroacetone and telluroacetophenone), telluroamides (for example, telluroacetamide and N,N-dimethyltellurobenzamide), tellurohydrazides (for example, N,N',N'-trimethyltellurobenzhydrazide), telluroesters (for example, t-butyl-t-hexyl telluroester), colloidal tellurium, (di) tellurides and other tellurium compounds (for example, potassium telluride and sodium telluropentathionate).

In noble metal sensitization, salts of noble metals such as gold, platinum, palladium and iridium are used as sanitizers. The noble metal salts are described in P. Glafkides, "Chimie et Physique Photographique", 5th ed., Paul Montel (1987) and *Research Disclosure,* 307, No. 307105. Gold sensitization is particularly preferred. Examples of the gold sensitizers include chloroauric acid, potassium chloroaurate, potassium aurithiocyanate, gold sulfide and gold selenide. Further, gold compounds described in U.S. Pat. Nos. 2,642,361, 5,049,484 and 5,049,485 can also be used.

In reduction sensitization, reducing compounds are used as sensitizers. The reducing agents are described in P. Glafkides, "Chimie et Physique Photographique", 5th ed., Paul Montel (1987) and *Research Disclosure,* 307, No. 307105. Examples of the reducing sensitizers include aminoimino-methanesulfinic acid (thiourea dioxide), borane compounds (for example, dimethylamine borane), hydrazine compounds (for example, hydrazine and p-tolylhydrazine), polyamine compounds (for example, diethylenetriamine and triethylenetetramine), stannous chloride, silane compounds, reductions (for example, ascorbic acid), sulfites, aldehyde compounds and hydrogen. Further, reduction sensitization can also be conducted in an atmosphere of high pH or excess silver ions (so-called silver ripening).

Chemical sensitization may be conducted as a combination of two or more kinds of sensitization processes. The combination of chalcogen sensitization and gold sensitization is particularly preferred. Further, reduction sensitization is preferably performed in forming the silver halide grains. The amount of the sensitizer used is generally determined depending on the kind of silver halide grain and the conditions of chemical sensitization. The amount of the chalcogen sensitizer used is generally from $10^{-8}$ mol to $10^{-2}$ mol, and preferably from $10^{-7}$ mol to $5\times10^{-3}$ mol, per mol of silver halide. The amount of the noble metal sensitizer used is preferably from $10^{-7}$ mol to $10^{-2}$ mol per mol of silver halide. There is no particular limitation on the conditions of chemical sensitization. The pAg is from 6 to 11, and preferably from 7 to 10. The pH is preferably from 4 to 10. The temperature is preferably from 40° C. to 95° C., and more preferably from 45° C. to 85° C.

The silver halide emulsions preferably contain various compounds in order to prevent fogging during manufacturing stages, storage or photographic processing of the photographic materials or in order to stabilize photographic properties thereof. Examples of such compounds include azoles (for example, a benzothiazolium salt, a nitroindazole compound, a triazole compound, a benzotriazole compound and a benzimidazole compound (particularly, a nitro- or halogen-substituted product)), heterocyclic mercapto compounds (for example, a mercaptothiazole compound, a mercaptobenzothiazole compound, a mercaptobenzimidazole compound, a mercaptothiadiazole compound, a mercaptotetrazole compound (particularly, 1-phenyl-5-mercaptotetrazole) and mercaptopyrimidine compound), the above-mentioned heterocyclic mercapto compounds having water-soluble groups such as carboxyl groups and sulfone groups, thioketo compounds (for example, oxazolinethione), azaindene compounds (for example, a tetraazaindene compound (particularly, 4-hydroxy-substituted (1,3,3a,7)-tetraazaindene compound)), benzenethiosulfonic acids and benzenesulfinic acids. In general, these compounds are known as antifoggants or stabilizers.

The antifoggants or the stabilizers are usually added after chemical sensitization. However, they can be added during chemical sensitization or before the initiation of chemical sensitization. That is to say, in the grain formation process of the silver halide emulsions, they may be added during the addition of the silver salt solutions, between after the addition and before the initiation of chemical sensitization, or during chemical sensitization (preferably within a period of time up to 50% from the initiation of chemical sensitization, and more preferably within a period of time up to 20% therefrom).

There is no particular limitation on the layer constitution of the silver halide photographic material. However, in the case of color photographic material, blue, green and red lights are separately recorded, so that the material has a multiple layer structure. Each silver halide emulsion layer may be comprised of two layers, a high-sensitivity layer and a low-sensitivity layer. Practical examples of the layer structures include (1) to (6) shown below.

(1) BH/BL/GH/GL/RH/RL/S
(2) BH/BM/BL/GH/GM/GL/RH/RM/RL/S
(3) BH/BL/GH/RH/GL/RL/S
(4) BH/GH/RH/BL/GL/RL/S
(5) BH/BL/CL/GH/GL/RH/RL/S
(6) BH/BL/GH/GL/CL/RH/RL/S

B is a blue-sensitive layer, G is a green-sensitive layer, R is a red-sensitive layer, H is a highest-speed layer, M is a medium-speed layer, L is a low-speed layer, S is a support, and CL is a layer for imparting an interlayer effect. Light-insensitive layers such as a protective layer, a filter layer, an intermediate layer, an anti-halation layer and a subbing layer are not shown. A high-speed layer and a low-speed layer each having the same color sensitivity may be arranged in reverse. (3) is described in U.S. Pat. No. 4,184,876, and (4) is described in *Research Disclosure,* 225, No. 22534, and Japanese Patent Laid-Open Nos. 177551/1984 and 177552/1984. Further, (5) and (6) are described in Japanese Patent Laid-Open No. 34541/1986. The preferred layer structures are (1), (2) and (4). The silver halide photographic materials of the present invention can also be applied to X-ray light-sensitive materials, black and white photographic materials, light-sensitive materials for plate making and photographic printing paper, as well as color photographic materials.

As for various additives for the silver halide emulsions (for example, binders, chemical sensitizers, spectral sensitizers, stabilizers, gelatin, hardeners, surfactants, antistatic agents, polymer latexes, matting agents, color couplers, ultraviolet absorbers, antifading agents and dyes), supports for the photographic materials and processing methods of the photographic materials (for example, coating methods, exposure methods and developing methods), reference can be made to the descriptions of *Research Disclosure,* 176, 17643 (RD-17643), ibid., 187, 18716 (RD-18716) and ibid., 225, 22534 (RD-22534). The descriptions of these Research Disclosures are shown in the following list:

| Type of Additive | RD-17643 | RD-18716 | RD-22534 |
|---|---|---|---|
| 1. Chemical Sensitizer | p. 23 | p. 648, right column | p. 24 |
| 2. Sensitivity Increasing Agent | | p.648, right column | |
| 3. Spectral Sensitizer, Supersensitizer | pp. 23–24 | p.648, right column to p. 649, right column | pp.24–28, |
| 4. Brightening Agent | p. 24 | | |
| 5. Antifoggant, Stabilizer | pp. 24–25 | p. 649, right column | p.24, p. 31 |
| 6. Light Absorber, Filter dye, UV Absorber | pp. 25–26 | p. 649, right column to p. 650, left column | |
| 7. Stain Inhibitor | p. 25, right column | p. 650, left to right columns | |
| 8. Dye Image Stabilizer | p. 25 | | p. 32 |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating Aid, Surfactant | pp. 26–27 | p. 650 right column | |
| 13. Antistatic Agent | p. 27 | p. 650 right column | |
| 14. Color Coupler | p. 25 | p. 649 | p. 31 |

As hardeners for gelatin, for example, an active halogen compound (such as 2,4-dichloro-6-hydroxy-1,3,5-triazine or a sodium salt thereof) and an active vinyl compound (such as 1,3-bisvinylsulfonyl-2-propanol, 1,2-bis (vinylsulfonylacetamido)ethane or a vinyl polymer having vinylsulfonyl groups on its chain are preferred, because they rapidly harden a hydrophilic colloid such as gelatin to give stable photographic characteristics. An N-carbamoylpyridinium salt (such as (1-morpholinocarbonyl-3-pyridinio)methane sulfonate) and a haloamidinium salt (such as 1-(1-chloro-1-pyridinomethylene)-pyrrolidinium 2-naphthalenesulfonate) can also be preferably used because of their rapid hardening rate.

The color photographic materials can be developed by usual methods described in *Research Disclosure,* 176, 17643 and ibid. 187, 18716. The color photographic materials are usually subjected to washing processing or stabilizer processing, after development, bleaching-fixing or fixing. In the washing stage, countercurrent washing is generally conducted using two or more tanks to economize in water consumption. Stabilization processing typically includes multistage countercurrent stabilization processing as described in Japanese Patent Laid-Open No. 8543/1982, in place of the washing stage.

EXAMPLE

The present invention will be described in detail below with reference to specific examples, but is not limited thereto.

Example 1

Preparation (1) of Emulsion 1-1: Octahedral Silver Bromide Emulsion Sample

To 870 ml of water, 36 g of deionized gelatin and potassium bromide were added, and dissolved therein. In the resulting aqueous gelatin solution kept at 75° C., 36 ml of a 0.083 M aqueous solution of silver nitrate (solution 1) and 36 ml of a 0.087 M aqueous solution of potassium bromide (solution 2) were quantitatively added with stirring for 10 minutes by the double jet method, and subsequently, 176 ml of solution 1 and 176 ml of solution 2 were added for 7 minutes by the double jet method. Then, 675 ml of a 0.82 M aqueous solution of silver nitrate (solution 3) was added for 60 minutes, accelerating the flow rate from an initial flow rate of 1.8 ml/minute. At the same time, a 0.83 M aqueous solution of potassium bromide (solution 4) was added while controlling the pBr so as to be kept at 2.93. Subsequently, 223 ml of solution 3 was further quantitatively for 25 minutes. At the same time, an aqueous solution of potassium bromide having the same concentration as solution 4 (solution 5) was added while controlling the pBr so as to be kept at 2.93. Five minutes after the termination of addition of the solution, the temperature was lowered to 35° C., and soluble salts were removed by a usual precipitation method. Then, the temperature was elevated again to 40° C., and 50 g of gelatin was additionally added and dissolved therein. Potassium bromide and 2-phenoxyethanol were further added, and the pH was adjusted to 6.5. The resulting grains were monodisperse octahedral silver bromide grains having a side length of 0.7 mm.

Emulsions 1-2 and 1-3: Octahedral Silver Bromide Emulsions Doped with $[Fe(CN)_6]^{4-}$ and $[IrCl_6]^{3-}$ (Comparison)

In the preparation of emulsion 1-1, $[Fe(CN)_6]^{4-}$ and $[IrCl_6]^{3-}$ ($\epsilon$=1.88 (at 415 nm)) were each added to solution 5 in an amount of $2.5\times10^{-4}$ mol per mol of silver, based on the total amount of silver added, thus obtaining emulsions 1-2 and 1-3 (the amount of silver added to this portion corresponds to 25% of the total silver amount, and this results in that each of these dopants was added to a surface layer of 75 to 100% in the grain volume).

Emulsions 1-4 to 1-8: Octahedral Silver Bromide Emulsions Doped with Respective Complexes of the Present Invention In the preparation of emulsion 1-1, $[Ru(CN)_5(pz)]^{3-}$(pz=pyrazole), $[Ru(acac)_2Cl_2]^{2-}$(acac=acetyl-acetone), $[Ru(5\text{-}NO_2phen)_3]^{2+}$(5-$NO_2$phen=5-nitro-1,10-phenanethroline), $[Ni(bt)_3]^{2+}$(bt=2,2'-bi-2-thiazoline) and $[Ni(tcdipr)_2]^0$ (tcdipr=1,2,6,7-tetracyano-3,5-dihydro-3,5-diimino-pyrrolizinide) were each dissolved in pure water, and each solution was added concurrently with addition of solution 5 by the triple jet method. Addition of the aqueous complex solution was terminated at the same time that addition of solution 5 was terminated. The respective complexes were added in an amount of $1\times10^{-4}$ mol per mol of silver, based on the total amount of silver added. Emulsions 1-4 to 1-8 were obtained by this method.

Each of the above-mentioned silver bromide emulsions 1-1 to 1-8, to which gelatin and sodium dodecylbenzenesulfonate were added, was applied in a silver amount of 2 g/$m^2$ onto a triacetyl cellulose film support having an undercoat layer, together with a protective layer containing gelatin, polymethyl methacrylate particles and 2,4-dichloro-6-hydroxy-s-triazine sodium salt by the extrusion method, thus obtaining coated samples 1-1 to 1-8.

In the measurement of an absorption spectrum of each sample, the spectrum of each sample was obtained as a spectrum in which absorption of silver halide and absorption of gelatin were subtracted from the absorption spectrum of each doped sample, using coated sample (1-1) not doped as a reference.

As for the emulsions doped with the respective complexes of the present invention, absorption wavelengths (maximum) thereof in the visible region are shown in Table 1.

TABLE 1

| Sample No. | Emulsion No. | Dopanta | Absorption Wavelength |
|---|---|---|---|
| 1-1 (Comparison) | 1-1 | Not added | Absorption was not observed |
| 1-2 (Comparison) | 1-2 | $[Fe(CN)_6]^{4-}$ | Absorption was not observed |
| 1-3 (Comparison) | 1-3 | $[IrCl_6]^{3-}$ | Absorption was not observed |
| 1-4 (Invention) | 1-4 | $[Ru(CN)_5(pz)]^{3-}$ | 475 nm |
| 1-5 (Invention) | 1-5 | $[Ru(acac)_2Cl_2]^{2-}$ | 705 nm |
| 1-6 (Invention) | 1-6 | $[Ru(5\text{-}NO_2phen)_3]^{2+}$ | 440 nm |
| 1-7 (Invention) | 1-7 | $[Ni(bt)_3]^{2+}$ | 525 nm |
| 1-8 (Invention) | 1-8 | $[Ni(tcdipr)_2]^0$ | 656 nm |

[a]The abbreviations of ligands in the respective dopants are as follows: pz = pyrazole, acac = acetyl-acetone, 5-$NO_2$phen = 5-nitro-1,10-phenanethroline, bt = 2,2'-bi-2-thiazoline and tcdipr = 1,2,6,7-tetracyano-3,5-dihydro-3,5-diimino-pyrrolizinide.

In $Fe(CN)_6$ for comparison, very weak, broad absorption was observed, but absorption in which the maximum value of a peak was clearly determinable was not observed. On the other hand, in the respective complexes of the present invention, clear absorption bands considered to be derived from doping were observed. In particular, in $[Ni(tcdipr)_2]^0$, intense, sharp absorption centered on 656 nm was observed.

Example 2

Preparation (2) of Coated Samples 2-1 to 2-8: Octahedral Silver Bromide Emulsion Samples Sodium thiosulfate, chloroauric acid and potassium thiocyanate were added to each of silver bromide emulsions 1-1 to 1-8 of Example 1 described above in amounts of $8.0\times10^{-6}$, $9.6\times10^{-6}$ and $3.4\times10^{-4}$ mol, per mol of silver, respectively, followed by optimum chemical sensitization at 60° C. Each of these chemically sensitized silver bromide emulsions 2-1 to 2-8, to which gelatin and sodium dodecylbenzenesulfonate were added, was applied in a silver amount of 2 g/$m^2$ onto a triacetyl cellulose film support having an undercoat layer, together with a protective layer containing gelatin, polymethyl methacrylate particles and 2,4-dichloro-6-hydroxy-s-triazine sodium salt by the extrusion method, thus obtaining coated samples 2-1 to 2-8.

Using a filter which intercepts light of 420 nm or less, exposure for sensitometry was given (for 1 second) to these coated samples through an optical wedge. Then, the samples were developed at 20° C. for 10 minutes using developing solution 1 obtained by the following formulation, and normally stopped, fixed, washed and dried, followed by the measurement of optical density. The fog was determined by the minimum optical density of the samples, and the sensitivity was indicated by the reciprocal of an exposure amount required to give an optical density of fog +0.1. The sensitivity was indicated as a relative value taking as 100 the value of the sample not doped. Table 2 shows the relative sensitivities of coated samples 2-1 to 2-8.

Developing Solution 1

| | |
|---|---|
| Metol | 2.5 g |
| L-Ascorbic Acid | 10.0 g |
| Nabox | 35.0 g |
| KBr | 1.0 g |

Water was added to bring the volume to 1 liter, and the pH was adjusted to 9.6.

TABLE 2

| Sample No. | Emulsion No. | Dopant[a] | Relative Sensitivity*1 |
|---|---|---|---|
| 2-1 (Comparison) | 2-1 | Not added | 100 |
| 2-2 (Comparison) | 2-2 | $[Fe(CN)_6]_{4-}$ | 155 |
| 2-3 (Comparison) | 2-3 | $[IrCl_6]_3$ | 63 |
| 2-4 (Invention) | 2-4 | $[Ru(CN)_5(pz)]^{3-}$ | 335 |
| 2-5 (Invention) | 2-5 | $[Ru(acac)_2Cl_2]^{2-}$ | 346 |
| 2-6 (Invention) | 2-6 | $[Ru(5\text{-}NO_2phen)_3]^{2+}$ | 340 |
| 2-7 (Invention) | 2-7 | $[Ni(bt)_3]^{2+}$ | 349 |
| 2-8 (Invention) | 2-8 | $[Ni(tcdipr)_2]^0$ | 366 |

[a]The abbreviations of ligands in the respective dopants are as follows: pz = pyrazole, acac = acetyl-acetone, 5-$NO_2$phen = 5-nitro-1,10-phenanethroline, bt = 2,2'-bi-2-thiazoline and tcdipr = 1,2,6,7-tetracyano-3,5-dihydro-3,5-diimino-pyrrolizinide.

In Table 2, there are shown the sensitivities of the respective emulsions at the time when exposed at a wavelength excluding the intrinsic absorption of silver bromide. No spectral sensitizing dye was added to each emulsion in each case, and sample not doped (2-1) had only light absorption corresponding to the bottom of the intrinsic absorption of silver bromide. Accordingly, slight optical density was only obtained. In the $Fe(CN)_6$-doped emulsion, an increase in sensitivity was observed, and the maximum value of optical density was raised, compared to the emulsion no doped. However, the sensitivity thereof is still incomparably lower than that of a sample using a spectral sensitizing dye. In contrast, in the samples doped with the respective complexes of the present invention, the sensitivity and optical density corresponding to those of a sample to which a spectral sensitizing dye was added were obtained, although no spectral sensitizing dye was added and the samples were exposed at a wavelength excluding the intrinsic absorption of silver bromide.

Example 3

Preparation (1) of Emulsion 3-1: Tabular Silver Iodobromide Grain Emulsion having (111) Plane as Main Plane One liter of a dispersing medium solution (pH: 5) containing 0.38 g of KBr and 0.5 g of low molecular weight gelatin (molecular weight: 15,000) was kept at 40° C. as a reaction solution. To this solution, 20 ml of a 0.29 M solution of silver nitrate and 20 ml of a 0.29 M solution of KBr were added by the double jet method with stirring for 40 seconds. After the addition, the temperature of this dispersing medium solution was elevated to 75° C. taking 15 minutes, and 15 minutes after the elevation in temperature, a dispersing medium solution containing 35 g of alkali-treated gelatin and 250 ml of water was newly added. After the pH was adjusted to 6.0, 734 ml of a 1.2 M solution of silver nitrate was added while accelerating the flow rate. During this period, a mixed solution of a KBr solution and a KI solution was added at the same time so as to keep the pBr at 2.93. In this case, the KI solution and the KBr solution were added in such amounts as to give 3 mol % of $I^-$ based on the amount of silver added.

Emulsion 3-2: Tabular Silver Iodobromide Emulsion Doped with $[Fe(CN)_6]^{4-}$ (Comparison)

In emulsion 3-1, $[Fe(CN)_6]^{4-}$ was added to a portion corresponding to 80% to 100% by the grain volume in an amount corresponding to $1\times10^{-4}$ mol per mol of silver based on the total silver amount, thereby preparing an emulsion, which was taken as emulsion 3-2.

Emulsions 3-3 to 3-6: Tabular Silver Iodobromide Emulsions Doped with $[Ru(CN)_5(pz)]^{3-}$, $[Ru(acac)_2Cl_2]^{2-}$, $[Ni(bt)_3]^{2+}$ and $[Ni(tcdipr)_2]^0$, Respectively (Invention)

In Emulsion 3-1, $[Ru(CN)_5(pZ)]^{3-}$, $[Ru(acac)_2Cl_2]^{2-}$, $[Ni(bt)_3]^{2+}$ and $[Ni(tcdipr)_2]^0$ were each added to a portion corresponding to 80% to 100% by the grain volume in an amount corresponding to $1\times10^{-5}$ mol or $1\times10^{-4}$ mol, per mol of silver based on the total silver amount. Thus, emulsions 3-3 to 3-6 were obtained.

To the above-mentioned emulsions 3-1 to 3-6, $8.0\times10^{-6}$ mol per mol of silver of sodium thiosulfate, $3\times10^{-6}$ mol per mol of silver of chloroauric acid and potassium thiocyanate were added, followed by optimum chemical sensitization at 60° C. These emulsions were applied in the same manner as with Example 1 to obtain coated samples 3-1 to 3-6.

Exposure for sensitometry was given (for $10^{-2}$ second) to these samples through an optical wedge. Then, the samples were developed in the same manner as with Example 1, and normally stopped, fixed, washed and dried, followed by the measurement of optical density. Table 3 shows the relative sensitivities of coated samples 3-1 to 3-6 at the time when the samples were exposed to light from which light of 420 nm or less was cut.

TABLE 3

| Sample No. | Emulsion No. | Dopant[a] | Amount of Dopant Added | Relative Relative Sensitivity*[1] |
|---|---|---|---|---|
| 3-1 (Comparison) | 3-1 | Not added | Not added | 100 |
| 3-2 (Comparison) | 3-2 | $[Fe(CN)_6]^{4-}$ | $1\times10^{-4}$ mol/mol Ag | 142 |
| 3-3 (Invention) | 3-3 | $[Ru(CN)_5(pz)]^{3-}$ | $1\times10P^{-4}$ mol/mol Ag | 226 |
| 3-4 (Invention) | 3-4 | $[Ru(acac)_2Cl_2]^{2-}$ | $1\times10^{-4}$ mol/mol Ag | 234 |
| 3-5 (Invention) | 3-5 | $[Ni(bt)_3]^{2+}$ | $5\times10^{-5}$ mol/mol Ag | 237 |
| 3-6 (Invention) | 3-6 | $[Ni(tcdipr)_2]^0$ | $5\times10^{-5}$ mol/mol Ag | 243 |

[a]The abbreviations of ligands in the respective dopants are as follows: pz = pyrazole, acac = acetyl-acetone, bt = 2,2'-bi-2-thiazoline and tcdipr = 1,2,6,7-tetracyano-3,5-dihydro-3,5-diiminopyrrolizinide.
*[1]Each is indicated by a relative sensitivity taking the sensitivity of sample 3-1 as 100.

Iodine was added herein to the grains forming the basis, so that the sensitivity of the sample not doped was raised when the sample was exposed to light of 420 nm or more. Accordingly, an increase in relative sensitivity of each doped emulsion was decreased. However, in each doped emulsion, a clear increase in sensitivity and optical density were obtained even at this exposure wavelength, similarly to Example 2.

When the silver halide grains are doped with the complexes used in the present invention, grains having sensitivity to wavelengths other than the intrinsic absorption of silver halides are obtained, even though spectral sensitizing dyes are not added. Accordingly, the silver halide photographic materials substantially higher in sensitivity than emulsions not doped or emulsions doped with existing dopants such as hexacyano complexes can be obtained.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A light-sensitive silver halide grain comprising a metal complex dopant having an absorption band which has a molar absorption coefficient of 10,000 or more in a wavelength region of visible light in an ultraviolet-visible absorption spectrum of a solution thereof, wherein the metal complex dopant has at least one heteorcyclic compound as a ligand, and the number of inorganic anions coordinating to a central metal in the metal complex dopant does not exceed the majority of the coordination number of the complex.

2. The light-sensitive silver halide grain as claimed in claim 1, wherein the metal complex dopant contained in the silver halide grain has an absorption band having a molar absorption coefficient of 10,000 or more between wavelengths of 380 nm and 780 nm.

3. The light-sensitive silver halide grain as claimed in claim 1, wherein the majority of coordination sites of the central metal of the metal complex dopant contained in the silver halide grain are occupied by heterocyclic compounds.

4. The light-sensitive silver halide grain as claimed in claim 1, wherein the central metal of the metal complex dopant contained in the silver halide grain is a metal or a metal ion selected from the group consisting of iron, cobalt, nickel, copper and ruthenium.

5. A silver halide emulsion comprising a silver halide grain, wherein the silver halide grain comprises a metal complex dopant having an absorption band which has a molar absorption coefficient of 10,000 or more in a wavelength region of visible light in an ultraviolet-visible absorption spectrum, wherein the metal complex dopant has at least one heterocyclic compound as a ligand, and the number of inorganic anions coordinating to a central metal in the metal complex dopant does not exceed the majority of the coordination number of the complex.

6. A silver halide photographic material comprising a support having thereon at least one silver halide emulsion layer, wherein a silver halide grain contained in the emulsion comprises a metal complex dopant having an absorption band which has a molar absorption coefficient of 10,000 or more in a wavelength region of visible light in an ultraviolet-visible absorption spectrum of a solution thereof, wherein the metal complex dopant has at least one heterocyclic compound as a ligand, and the number of inorganic anions coordinating to a central metal in the metal complex dopant does not exceed the majority of the coordination number of the complex.

* * * * *